US007026948B1

(12) United States Patent
Rutter et al.

(10) Patent No.: US 7,026,948 B1
(45) Date of Patent: Apr. 11, 2006

(54) ALARM WITH REMOVABLE DETECTION CIRCUITRY CARTRIDGE

(75) Inventors: Nicholas Alexander Rutter, Conventry (GB); Simon Paul Tate, Conventry (GB)

(73) Assignee: Runner & Sprue Limited, Coventry (GB)

( * ) Notice: Subject to any disclaimer, the term of this patent is extended or adjusted under 35 U.S.C. 154(b) by 0 days.

(21) Appl. No.: 09/937,450

(22) PCT Filed: Mar. 27, 2000

(86) PCT No.: PCT/GB00/01150

§ 371 (c)(1),
(2), (4) Date: Sep. 25, 2001

(87) PCT Pub. No.: WO00/58924

PCT Pub. Date: Oct. 5, 2000

(30) Foreign Application Priority Data

Mar. 25, 1999 (GB) ..... 9906784

(51) Int. Cl.
*G08B 23/00* (2006.01)

(52) U.S. Cl. ..... 340/693.5; 340/627

(58) Field of Classification Search ..... 340/627, 340/628, 632, 693.5, 693.6, 693.9, 693.11
See application file for complete search history.

(56) References Cited

U.S. PATENT DOCUMENTS 4,072,933 A 2/1978 Pun ..... 340/229
4,139,770 A 2/1979 Beyersdorf ..... 250/381
4,369,435 A * 1/1983 Adachi et al. ..... 340/506
4,384,488 A * 5/1983 Scheidweiler ..... 73/431
4,608,556 A * 8/1986 Cole ..... 340/628
4,757,303 A 7/1988 Scheidweiler ..... 340/501
4,812,827 A * 3/1989 Scripps ..... 340/693.1
4,827,247 A 5/1989 Giffone ..... 340/630
4,829,283 A * 5/1989 Spang et al. ..... 340/506
4,839,562 A 6/1989 Francis et al. ..... 315/149
4,887,073 A * 12/1989 Nakao et al. ..... 340/693
4,980,672 A * 12/1990 Murphy ..... 340/571
5,172,096 A * 12/1992 Tice et al. ..... 340/501
5,280,273 A * 1/1994 Goldstein ..... 340/632
5,432,500 A * 7/1995 Scripps ..... 340/628
5,440,293 A * 8/1995 Tice ..... 340/568
5,705,979 A 1/1998 Fierro et al. ..... 340/517
5,729,207 A * 3/1998 Yamano ..... 340/628
5,912,626 A * 6/1999 Soderlund ..... 340/693.5
6,078,269 A * 6/2000 Markwell et al. ..... 340/825.5
6,150,936 A 11/2000 Addy ..... 340/539

FOREIGN PATENT DOCUMENTS

DE 197 33 375 A 1 2/1999

* cited by examiner

*Primary Examiner*—Phung T. Nguyen
(74) *Attorney, Agent, or Firm*—Mitchell Silberberg & Knupp LLP

(57) ABSTRACT

Provided is an alarm for detecting heat, radiation and/or pollutants. The alarm includes housing means and also includes detection means for detecting the heat, radiation and/or pollutants. The detection means, in turn, includes detection circuitry and a power source, and is contained within a cartridge that is mountable within the housing means and removable therefrom.

15 Claims, 3 Drawing Sheets

ALARM WITH REMOVABLE DETECTION CIRCUITRY CARTRIDGE

This is a national application that was filed from PCT/GB00/01150, which PCT application was filed on Mar. 27, 2000, and was published under PCT Article 21(2) in English, and which in turn claimed priority to UK patent application G08B17/113 which was filed on Mar. 25, 1999.

BACKGROUND OF THE INVENTION

1. Field of the Invention

The present invention relates to an alarm for detecting radiation and/or air pollutants such as smoke, carbon monoxide, methane, radon or the like.

2. Description of the Related Art

It is known that contamination of detecting circuitry in a smoke alarm or the like, for example by dust or dirt, can occur with the result that the sensitivity of the smoke detection circuitry is compromised. Consequently, it is recommended that such circuitry is replaced on a regular basis, for example every ten years.

A disadvantage associated with existing detectors is that they are often provided with the detection circuitry fixedly mounted to an outer housing as a single integrated unit. Replacement of the detection circuitry therefore necessitates replacement of the entire unit which, as the unit is normally mounted to a room ceiling by means of screws or the like, is often a complicated and time-consuming process.

U.S. Pat. No. 5,280,273 discloses a detector for sensing the presence of a toxic gas having a housing comprising a base and a cover. Detection circuitry is fixed inside the housing and biomimetric sensing material and a battery are contained in a cell which can be inserted and withdrawn from the housing by means of a drawer.

DE 197 33 375 discloses a device for fire detection having a housing comprising a base component and a cover component. The cover component is provided with a printed circuit board fitted with electronic components for fire detection.

BRIEF SUMMARY OF THE INVENTION

The present invention seeks to provide an improved alarm.

Accordingly, the present invention provides an alarm for detecting radiation and/or pollutants such as smoke, carbon monoxide or the like having:

housing means; and detection circuitry for detecting said radiation and/or pollutants;

wherein said detection circuitry is contained within a cartridge which is mountable in said housing means and detachable therefrom.

Preferably, said housing means comprises an upper housing member and a base, the upper housing member and the base being adapted to be fitted together.

Advantageously, the base comprises support means and carrier means slidably mounted on the support means, the carrier means being for seating the detection means thereon thereby to permit easy removal of the detection means.

The present invention will now be described, by way of example only, with reference to the accompanying drawings in which:

DETAILED DESCRIPTION OF THE INVENTION

Figure 1:
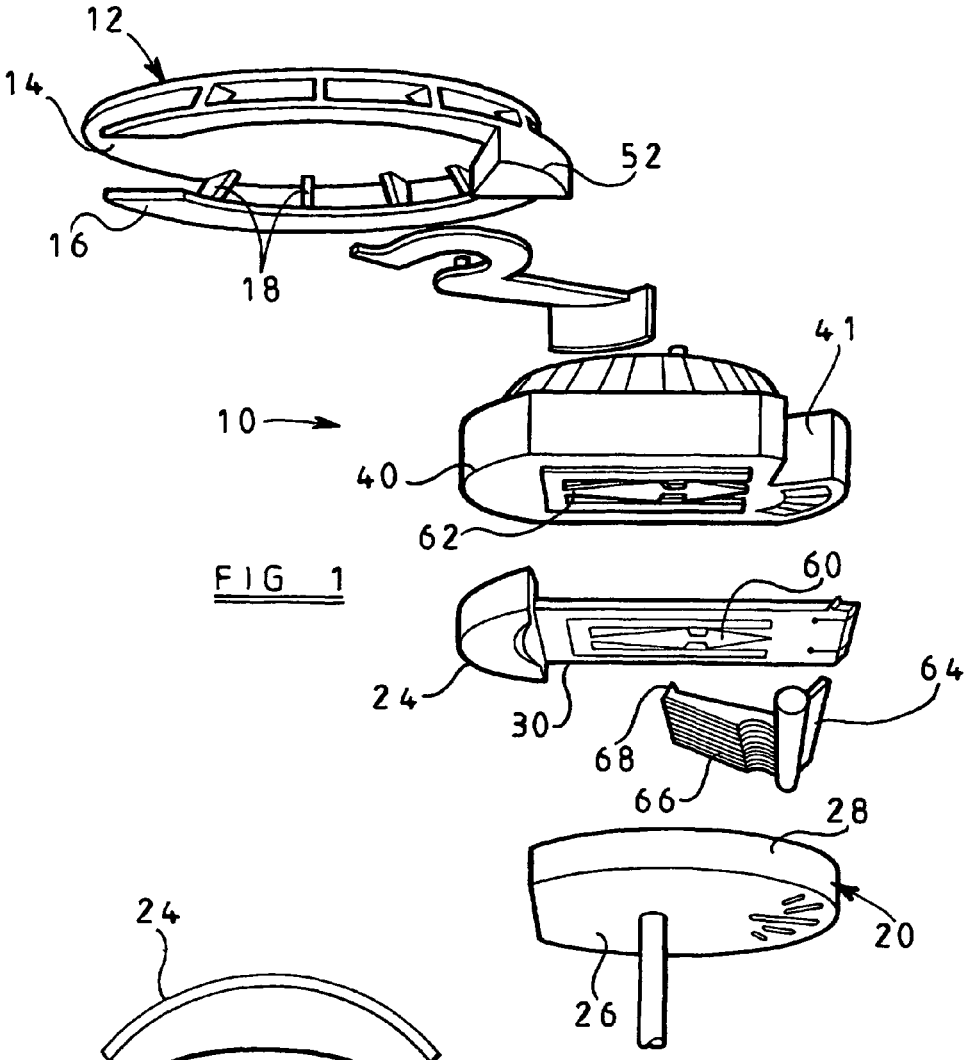
FIG. 1 is a perspective view of a preferred form of alarm according to the present invention in disassembled form.
Figure 2:
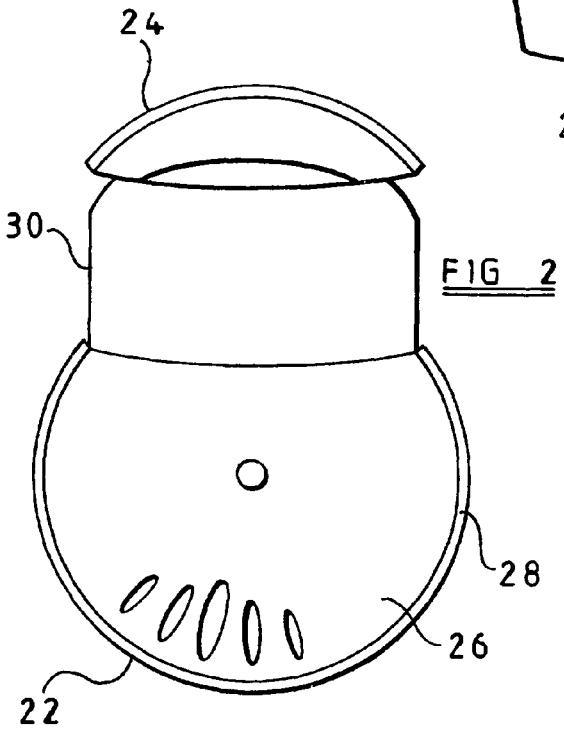
FIG. 2 is a first inverse plan view of a base of the alarm of FIG. 1.
Figure 3:
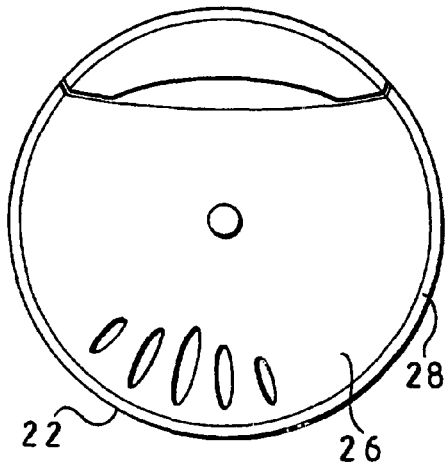
FIG. 3 is a second inverse plan view of the base of FIG. 2.

Referring to FIGS. 1–3, there is shown a preferred form of alarm 10 according to the present invention. In this embodiment, the alarm 10 is a smoke alarm and is intended to replace a conventional ceiling rose for an electric light fitting. Conveniently, therefore, the alarm is powered by the electricity supply to the light fitting. A back-up battery is also provided for use during times when the light fitting is switched off. The electricity supply is additionally used to charge the battery.

The smoke alarm 10 has an outer housing comprising two portions 12, 20 adapted to be fitted together. The first part is an upper housing member 12 in the form of a substantially circular plate 14 which is intended to be mounted on a ceiling of a room by means of screws or the like (not shown). The upper housing part 12 also has connecting means, in the form of a U-shaped strip 16, for connecting the two parts of the housing together. The strip 16 is rigidly connected to the plate by a plurality of struts 18 which extend downwardly from a lower face of the plate. The strip 16 and the plate 14 are thus connected in spaced apart relationship with their planes being substantially parallel.

The second part of the housing is a base 20, a plan view of which is shown in FIGS. 2 and 3. The base 20 is formed in two parts, a supporting member 22 and a carrier 24. The supporting part 22 takes the form of a truncated circular plate 26 with a raised rim 28 extending around the curved part of its perimeter. The carrier part 24 takes the form of a drawer or tray 30 which is mounted for sliding movement in to and out of the supporting part 22 in the direction of the arrow A. As can be seen from FIG. 3, when the tray 30 is fully pushed into the supporting part 22, the base forms a closed circular plate with a rim extending fully around its circumference.

Figure 4:
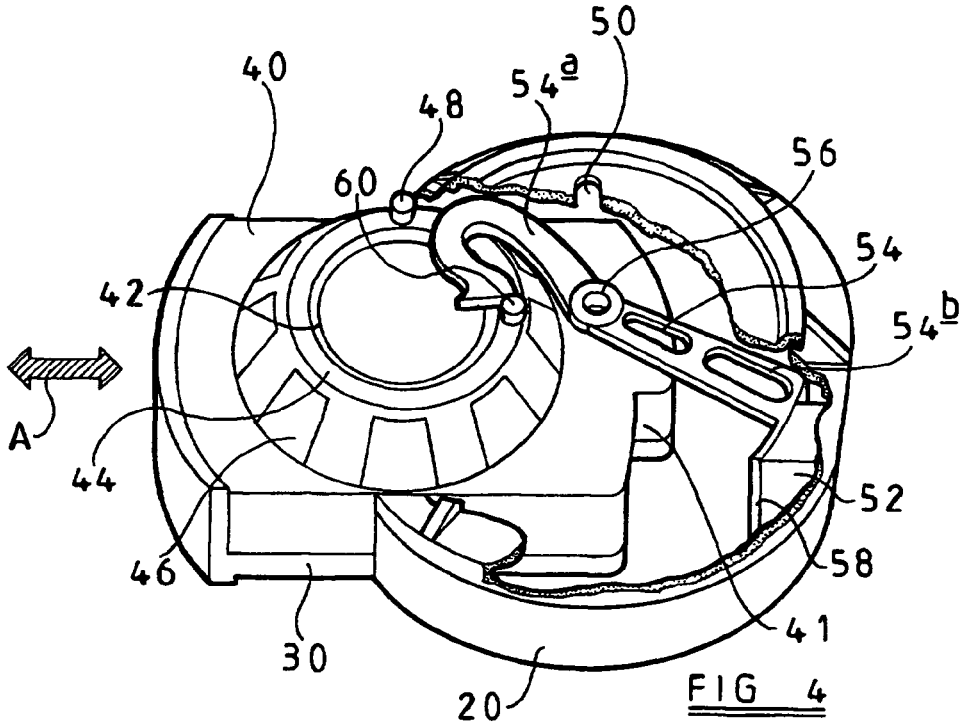
FIG. 4 is a perspective view, partly in section, of the alarm of FIG. 1 in partly assembled form.
Figure 5:
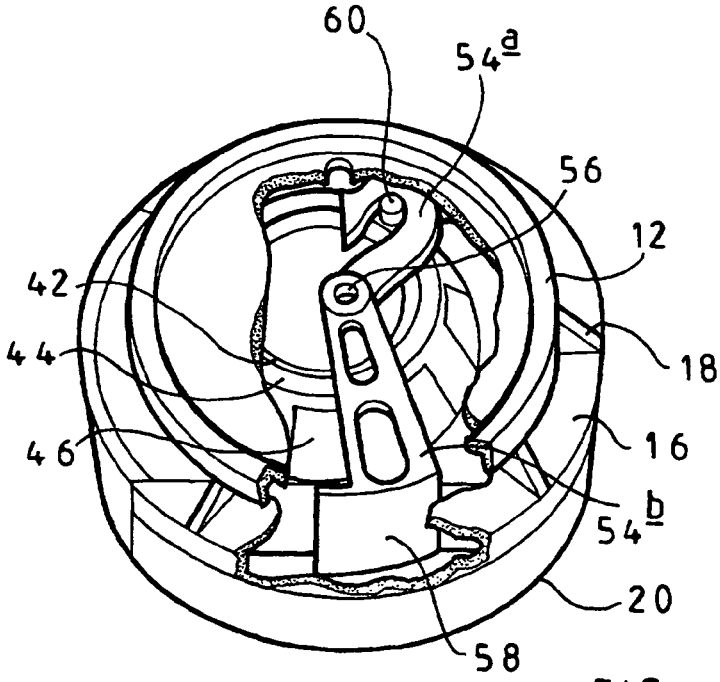
FIG. 5 is a perspective view of the alarm of FIG. 1 in fully assembled form.

As best shown in FIG. 4, the base 20 is adapted to be fastened to the upper housing portion 12 to form an outer housing assembly which is substantially circular in cross section and which has flat upper and lower surfaces defined by the outer surfaces of the plates 14, 26. The housing assembly is arranged such that the tray 30 of the base 20 is able to slide in and out of the housing assembly in the direction denoted by the arrow.

Referring back to FIG. 1, the smoke alarm 10 includes a cartridge 40 containing smoke detection circuitry, a battery and an alarm sounder (not shown). The cartridge 40 is fully self-contained and can, in fact, operate independently of the housing assembly. The cartridge 40 is adapted to be seated on the tray 30 of the base 20 such that it can be pushed into and drawn out of the housing assembly.

The cartridge 40 has a recess 41 for engagement with electrical connection means provided in the housing assembly as described below. The cartridge 40 has on its upper surface two coaxial, truncated cones 42, 44 each having a plurality of windows 46 disposed equidistantly around their circumferences. The inner cone 42 is fixed relative to the upper surface of the lower portion of the cartridge 40 whereas the outer cone 44 is rotatable relative to the inner cone 42 and to the upper surface. As the outer cone is rotated relative to the inner cone, the windows 46 in the cones are alternately aligned and disaligned depending on the relative positions of the two cones. Alignment of the windows of the cones 42, 44 provides a plurality of openings into the cartridge for the passage of smoke.

It is preferable, before the cartridge 40 is inserted into the housing assembly, that the windows are disaligned such that no openings into the cartridge are provided. This is to ensure that the smoke detection circuitry within the cartridge 40 is not contaminated by dirt or dust prior to its insertion in the housing assembly.

In order to align the windows 46 in the cones 42, 44 when the cartridge 40 is inserted in the housing assembly, the smoke alarm 10 includes alignment means in the form of a spigot 48 extending upwardly from an upper surface of the outer cone 44, and an associated shoulder 50 formed in the upper housing member 12. As the cartridge 40, seated on the tray 30 is pushed into the housing assembly, the spigot 48 engages with the shoulder 50 and causes the outer cone 44 to rotate (anticlockwise in the drawings) relative to the inner cone 42 and thus align the windows to form the apertures into the cartridge 40.

As can be seen, therefore, the windows are aligned to provide the openings into the cartridge only as the cartridge is inserted into the housing assembly. This prevents the need for the openings to be formed prior to insertion of the cartridge in the housing, thus reducing the likelihood of contamination by dust or dirt of the smoke detection circuitry within the cartridge 40.

Referring to FIG. 1, the upper housing member has connection means 52 for connecting the smoke alarm to an extended electricity supply. It will be appreciated that the external electricity supply may be that for powering the light fitting or any other external supply. The connection means 52 is adapted to engage in the recess 41 of the cartridge 40. A radially inner surface of the connection means includes plugs and/or sockets for coupling the electricity supply to the cartridge 40 as the cartridge is inserted into the housing. The cartridge 40 has corresponding plugs/sockets which engage the plugs/sockets of the connection means 52.

To prevent a user accidentally touching the plugs/sockets of the connection means, the smoke alarm 10 includes isolating means in the form of an arm 54 which is connected to the underside of the upper housing member and is rotatable relative to the upper housing member about a pivot point 56. On one side of the pivot point, the arm extends in a substantially U-shaped portion 54*a*, the purpose of which is described below. On the other side of the pivot, the arm 54*b* extends radially outwardly and has at its end an arcuate flange 58 extending downwardly, perpendicular to the plane of the arm 54.

Before insertion of the cartridge 40 into the housing assembly, the flange 58 is aligned with the connection means 52 so as to cover the plugs/sockets and thereby isolate them from a user as shown in FIG. 4. As the cartridge is inserted into the housing by means of the tray 30, the rotation of the outer cone 44 caused by engagement of the spigot 48 with shoulder 50 causes a second spigot 60 also extending perpendicularly upward from the upper surface of the outer cone 44 to engage in the U-shaped portion 54*a* of the arm 54.

As the cartridge is further inserted into the housing assembly, the second spigot 60, engaged in the U-shaped portion of the arm, causes rotation of the arm in the clockwise direction as shown in FIG. 4 such that the flange 58 is rotated away from the connection means 52 thereby allowing the plugs and/or sockets to connect with the corresponding plugs and sockets on the cartridge 40.

If the cartridge 40 is withdrawn from the outer housing, the second spigot 60 engaged in the U-shaped portion 54*a* of the arm 54, causes the arm to rotate in the anticlockwise direction and thus draw the flange back in front of the connection means thereby to isolate the plugs and/or sockets of the connecting means from the user.

It can be seen that the present invention provides an alarm having the advantage that replacement of the detection circuitry is effected quickly and easily without necessitating removal of the entire unit from the ceiling. This is achieved by providing the detecting circuitry in a discrete cartridge which is inserted into a housing assembly by means of a sliding tray and which connects with an electricity supply within the housing assembly.

Furthermore, since the cartridge 40 is fully self-contained, replacement of the cartridge means replacement of the electronic circuitry, battery and sounder providing optimum reliability for the alarm.

It will be appreciated, however, that the invention is not limited to an alarm for detecting smoke. The invention is equally applicable to an alarm for detecting radiation, for example heat (infrared) or the like, and/or for detecting gaseous air pollutants such as carbon monoxide, methane and radon or the like. Furthermore, a single cartridge may be adapted to have detection circuitry for detecting two or more of the above, for example smoke and carbon monoxide or smoke, heat and methane, or any other combination.

Various modifications and improvements can be made to the invention. For example, in order to ensure that only the correct type of cartridge is inserted into the housing assembly, the tray 30 can be formed with cut-outs or apertures 60 formed in it as shown in FIG. 1. The underside of the cartridge 40 can be formed with cooperating raised portions or protrusions 62 which match the shape and depth of the apertures 60 such that when the cartridge 40 is seated correctly on the tray 30, the protrusions are engaged in the apertures and the underside of the tray is thus uniform and smooth.

Locking means in the form of a rake 64 may be fixed in the base 20. The rake has prongs 66 inclined from the horizontal and pointing towards the direction from which the tray 30 is inserted. The prongs 66 have upturned teeth 68 which engage in the apertures 60. If a correct cartridge 40 is seated on the tray 30 with its protrusions 62 engaged in the apertures 60, the teeth 68 of the rake 64 bear upwardly on, and slide across, the uniform underside of the tray 30 as it is pushed into the housing assembly. If, however, an incorrect cartridge (having no/incorrect protrusions on its underside) is seated on the tray 30, the teeth 68 of the rake 64 engage in the apertures on the underside of the tray as it is pushed into the housing assembly assembly so as to lock the tray and prevent it from being fully inserted.

Moreover, the protrusions on the cartridge and the apertures in the tray can be shaped to distinguish between, for example, a methane alarm and a smoke alarm. This ensures that only the correct type of cartridge can be used in a given alarm.

The alarm may also provided with means for indicating when replacement of the cartridge should occur. This may be achieved by a simple electronic timer which measures the life of the cartridge and indicates, for example by means of an LED, when the unit has been in place for 10 years which is the recommended maximum life of a smoke alarm. Alternatively, the condition of the detection circuitry or the battery may be monitored to provide an indication as to when the cartridge should be replaced.

If a timer is used it can be arranged to begin counting down only after the unit is inserted, energized, removed from it's pacing or otherwise actuated.

Figure 6:
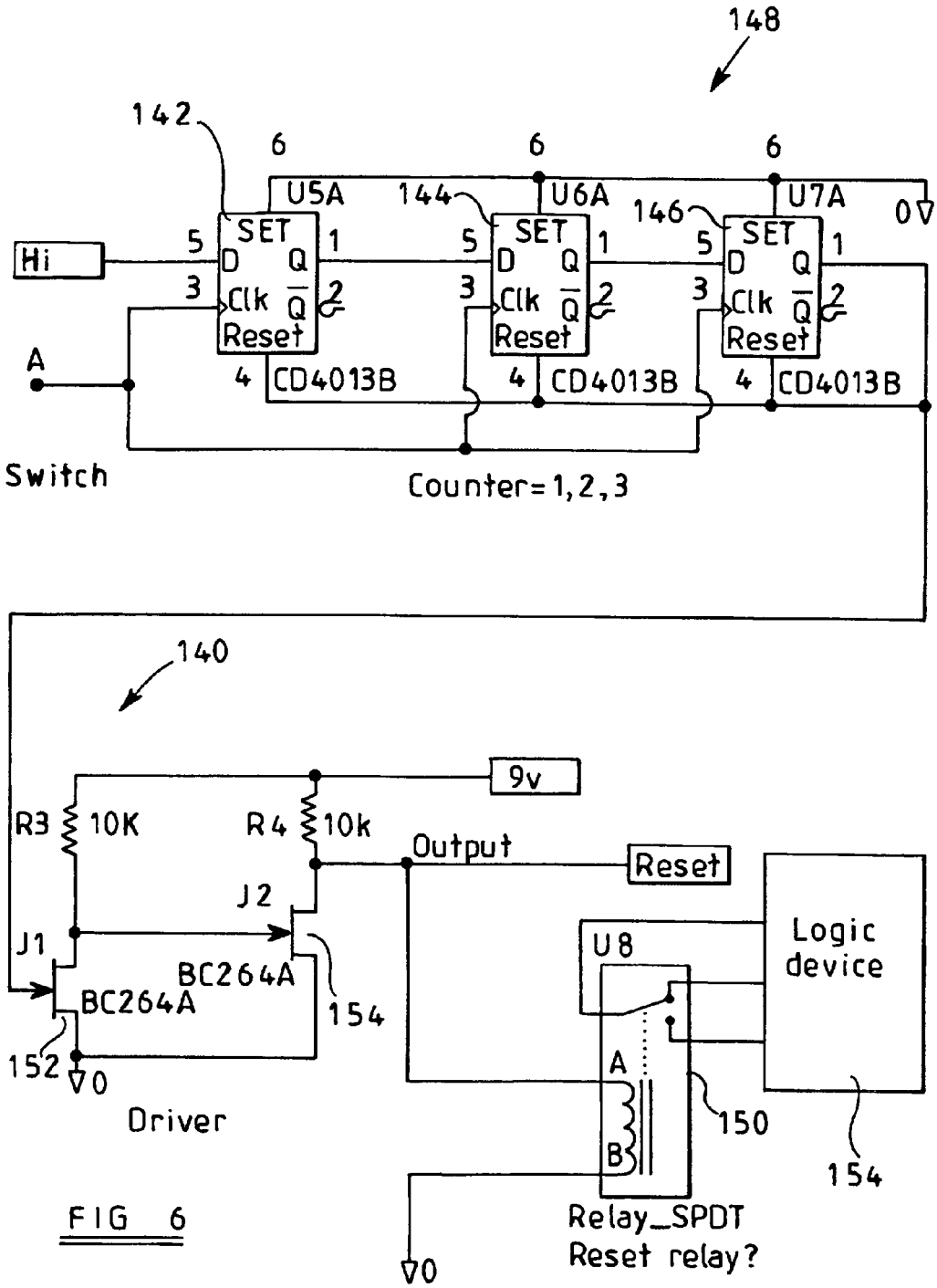
FIG. 6 is a circuit diagram of a reset/test circuit for the alarm.

Referring now to FIG. 6, this shows a control circuit 140 which can be used to reset the smoke alarm. The circuit 40 has three flip-flops 142, 144, 146 which are arranged to provide an output which is high in response to three input pulses on terminal three of the first flip-flop 142. Terminal three is connected to the output of the rectifier and filter unit 132 whilst terminal five of the flip-flop 142 is held high. The effect of this is that if the light switch providing power to the transformer 130 is flicked on and off rapidly three times the output of the counter circuit 148 formed by the flip-flops 142, 144, 146 goes high.

The output of the counter circuit 148 drives a relay 150 through a pair of MOS field effect transistors 152, 154, the relay in turn applying a reset signal to a logic device 154 which may be included in the reset circuit 138 or external to the reset circuit 138 and controlling the reset circuit in order to reset the alarm 136. As an alternative to the relay 150, the output of transistor 154 could be applied directly to the reset circuit 158 in order to reset the alarm.

Whilst three "flicks" of the light switch are used to reset the alarm, it will be appreciated that this number may be varied and the time period during which the "flicks" must be effected can also be varied. In addition, a different number of "flicks" of the light switch could be used, through the logic device 154, to test the alarm or to perform an alternative function such as a change of mode of the alarm, for example to detect a different pollutant such as carbon monoxide.

As an alternative to the circuit of FIG. 6 being actuated via a direct electrical signal from the charging circuit, it could be effected by way of a signal generated by a light sensor tripped by rapid ON and OFF switching of the light bulb.

During manufacture of the alarm, it is often the case that the battery supplied by the manufacturer may have a low charge. The alarm of the present invention is provided with circuitry which generates an audible warning from the buzzer 122 when the charge of the battery falls below a certain level. If the battery provided by the manufacturer already contains a low charge, during shipping of the unit it is possible that the audible low charge warning is constantly generated. This can be inconvenient and can further reduce the charge on the battery. It is preferable, therefore, to provide means for disconnecting, for example, the buzzer or the battery, from the circuitry during shipping. This may be achieved, for example, by providing a strip of non-conducting material such as polythene between either the buzzer or the battery and the circuit board. An end of the strip of non-conducting material projects out of the main housing of the alarm such that it can be pulled and withdrawn from between the buzzer and the circuit board prior to, or just after, insertion of the alarm into the ceiling rose light fitting. Once the alarm has been plugged into the light fitting, the lighting circuitry can be switched on such that a trickle charge is provided to the battery as described earlier, thereby to charge to the battery.

Alternatively, the alarm circuitry can be silenced in the above manner by building a short-circuit into the unit preventing the sounder from operating. This short circuit can, for example, be attached to a form of rip-cord which is removed before the cartridge is inserted. When the rip-cord is pulled the short circuit is permanently broken allowing the circuitry to function as intended. This gives the advantage of allowing the circuitry to be permanently soldered giving greater durability.

Further more, rather than being manually actuated, the rip-cord can be actuated automatically (eg when the cartridge is inserted or removed from its packaging) or electrically (eg the short component is blown) and can also be combined with the actuator of the count down timer as previously described.

An external sensitivity adjustment which is variable in discrete steps or continuously may also be provided on the alarm. Alternatively, to further reduce the degrading effect of heat on the performance and effectiveness of the detection circuitry, the sensitivity of the circuitry may be automatically adjustable such that as the temperature of the circuitry rises, its sensitivity is increased. Thus any degradation in the performance of the detection circuitry is substantially compensated for by an increase in detector sensitivity.

What is claimed is:

1. A system for detecting heat, radiation and/or pollutants, said system comprising:

a housing assembly; and a cartridge detachably mountable within said housing assembly, wherein said cartridge contains a detection apparatus for detecting at least one of heat, radiation and pollutants, and wherein said detection apparatus includes detection circuitry, a power source and an alarm such that said cartridge is operable independently of said housing assembly to detect said at least one of heat, radiation and pollutants and to activate said alarm upon said detection.

2. A system according to claim 1 wherein said housing assembly comprises an upper housing member and a base, the upper housing member and the base being adapted to be fitted together so as to provide an opening to slidably receive the cartridge within said housing assembly.

3. A system according to claim 2 wherein the base comprises:

support means; and carrier means slidably mounted on the support means for sliding movement into and out of said housing assembly, wherein said carrier means is adapted to seat the cartridge thereon for insertion of said cartridge into said housing assembly.

4. A system according to claim 1, wherein the housing assembly further comprises a ceiling mount.

5. A system according to claim 1, wherein the cartridge is slidably mountable within the housing assembly.

6. A system according to claim 5, wherein the housing assembly includes a carrier for slidably mounting the cartridge within the housing assembly.

7. A system according to claim 6, wherein the carrier comprises at least one of a drawer and a tray.

8. A system according to claim 1, wherein the housing assembly includes a first connector for connecting to an external electrical power supply.

9. A system for detecting heat, radiation and/or pollutants, said system comprising:

a housing assembly;

a cartridge detachably mountable within said housing assembly;

a first electrical connector located within said housing assembly and connectable to an external power supply; and a second electrical connector disposed on said cartridge and electrically connected to said detection apparatus, wherein said cartridge contains a detection apparatus for detecting at least one of heat, radiation and pollutants, wherein said detection apparatus includes detection circuitry, a power source and an alarm such that said cartridge is operable independently of said housing assembly to detect said at least one of heat, radiation and pollutants and to activate said alarm upon said detection, and wherein said second electrical connector is engageable with said first electrical connector when said cartridge is inserted fully into said housing assembly, thereby allowing said detection apparatus to be powered by said external power supply.

10. A system according to claim 9, further comprising a cover that is movable between first and second positions in response to insertion and removal of said cartridge into and from said housing assembly, and wherein in said first position said cover restricts physical access to the first electrical connector and in said second position said cover allows engagement of said first and second electrical connectors.

11. A system according to claim 9, wherein said cartridge further comprises a control circuit responsive to the energizing and de-energizing of said external power supply a preset number of times over a preset time period to apply a reset signal to the detection apparatus, thereby to reset the detection apparatus.

12. A system according to claim 9, wherein said cartridge has a control circuit responsive to the energizing and de-energizing of said external power supply a preset number of times over a preset time period to apply a test signal to the detection apparatus, thereby to test the detection apparatus.

13. A system for detecting heat, radiation and/or pollutants, said system comprising:

a housing assembly; and a cartridge detachably mountable within said housing assembly, wherein said cartridge contains a detection apparatus for detecting at least one of heat, radiation and pollutants, and wherein said detection apparatus includes detection circuitry, a power source and an alarm such that said cartridge is operable independently of said housing assembly to detect said at least one of heat, radiation and pollutants and to activate said alarm upon said detection, and wherein the cartridge has a plurality of apertures to allow passage of said at least one of heat, radiation and pollutants into the cartridge for detection by said detection apparatus, and wherein said cartridge further comprises closure means on said cartridge for closing said apertures, said closure means being movable between first and second positions, wherein in said first position said closure means closes said apertures and in said second position said closure means opens said apertures.

14. A system according to claim 13, wherein said closure means is movable between said first and second positions in response to insertion and removal of said cartridge into and from said housing assembly.

15. A system for detecting heat, radiation and/or pollutants, said system comprising:

a housing assembly that includes a first connector for connecting to an external electrical power supply and a second connector for connecting the cartridge to electrical power from the external electrical power supply; and a cartridge detachably mountable within said housing assembly, wherein said cartridge contains a detection apparatus for detecting at least one of heat, radiation and pollutants, and wherein said detection apparatus includes detection circuitry, a power source and an alarm such that said cartridge is operable independently of said housing assembly to detect said at least one of heat, radiation and pollutants and to activate said alarm upon said detection.

* * * * *